United States Patent [19]

Stauber

[11] Patent Number: 4,615,517

[45] Date of Patent: Oct. 7, 1986

[54] APPARATUS FOR PLACING FLAT COVER ELEMENTS, PREFERABLY COVER SHEETS, ON STACKS OF FLAT ARTICLES, PREFERABLY PRINTED PRODUCTS

[75] Inventor: Hans-Ulrich Stauber, Grüt, Switzerland

[73] Assignee: Ferag AG, Hinwil, Switzerland

[21] Appl. No.: 778,810

[22] Filed: Sep. 23, 1985

[30] Foreign Application Priority Data

Sep. 24, 1984 [CH] Switzerland ..... 4560/84

[51] Int. Cl.[4] ..... B65H 39/02; B65H 7/02

[52] U.S. Cl. ..... 270/58; 271/259; 271/264; 271/265; 271/267

[58] Field of Search ..... 270/58; 271/256, 259, 271/264, 265, 267, 268, 272, 4, 9

[56] References Cited

U.S. PATENT DOCUMENTS

| | | | |
|---|---|---|---|
| 3,583,696 | 6/1971 | Runzi | 271/4 |
| 3,807,723 | 4/1974 | Thomas | 271/9 |
| 3,970,384 | 7/1976 | Yamamoto et al. | 271/259 X |
| 4,057,243 | 11/1977 | Fujimoto | 271/256 |
| 4,077,620 | 3/1978 | Frank et al. | 271/259 |
| 4,153,242 | 5/1979 | Mizuma | 271/9 |
| 4,157,822 | 6/1979 | Miller | 271/9 |
| 4,171,130 | 10/1979 | Jeschke et al. | 271/259 |
| 4,244,564 | 1/1981 | Brown | 270/58 |
| 4,465,192 | 8/1984 | Ohba et al. | 271/9 |
| 4,471,954 | 9/1984 | Bourg | 270/58 |
| 4,560,293 | 12/1985 | McCumber et al. | 271/9 |

*Primary Examiner*—E. H. Eickholt

*Attorney, Agent, or Firm*—Werner W. Kleeman

[57] ABSTRACT

The cover sheet which is to be placed, is brought into a waiting position above a predetermined conveying path of the stacks of flat articles. The cover sheet is displaced from this waiting position onto one stack by means of a placing element arranged at the end of a piston rod of a piston cylinder unit. The piston-cylinder unit is pivotably mounted about an axis which extends at right angles to a predetermined travel or movement direction of the stack. In its rest position the piston-cylinder unit lies against a pad or buffer which keeps the piston-cylinder unit in an inclined position. By extending the piston rod, the cover sheet is placed onto a stack. The placing element which presses on the stack, is entrained by the further moving stack. Thus the piston-cylinder unit is deflected from its rest position. As soon as a detector detects such a deflecting movement, the detector generates a signal which triggers retraction of the piston rod. The reversal of the movement of the piston rod is thus effected in a simple manner. The inclination of the piston-cylinder unit together with the placing element permits positionally correct placement of cover sheets onto stacks of various heights without requiring a special control arrangement.

21 Claims, 9 Drawing Figures

APPARATUS FOR PLACING FLAT COVER ELEMENTS, PREFERABLY COVER SHEETS, ON STACKS OF FLAT ARTICLES, PREFERABLY PRINTED PRODUCTS

CROSS REFERENCE TO RELATED APPLICATION

This application is related to my commonly assigned, co-pending U.S. patent application, Ser. No. 06/778,615, filed Sept. 23, 1985, and entitled "APPARATUS FOR SUPERPOSING FLEXIBLE FLAT ARTICLES, ESPECIALLY SHEETS AND SIGNATURES, AND METHOD OF USING SUCH APPARATUS".

BACKGROUND OF THE INVENTION

The present invention relates to a new and improved construction of an apparatus for placing flat cover elements, preferably cover sheets, on stacks of flat articles, preferably printed products.

In its more particular aspects, the present invention specifically relates to a new and improved apparatus for placing flat cover elements, preferably cover sheets, onto stacks of flat articles, preferably printed products, and which contains a placing element which is displacable between an upper standby or preparatory position and a lower operative position for displacing the cover elements or sheets from a waiting position onto one of the stacks. The one stack is movable along a predetermined conveying path past the placing or placement element. The apparatus further possesses a control means or arrangement for controlling the movement or displacement of the placing element which, on arrival of a stack, triggers a displacement of the placing element towards its operative position and, after placing the cover element onto the stack, effects a return movement of the placing element towards its standby or preparatory position.

In an apparatus of this type as known, for example, from Swiss Pat. No. 545,741, granted Dec. 31, 1973, the stacks or paper stacks which are to be provided with a cover sheet, are moved with constant speed past a cover element or sheet placing station by means of a conveyor belt. At this placing station a cover element or sheet is placed onto the passing stack without the stacks having to be stopped for this purpose. The placing of the cover elements or sheets occurs with the assistance of a placing element or ram which can be raised or lowered in a direction which extends at right angles to the conveying direction of the stack. In a preparatory position of the ram the latter entrains a cover element or sheet and places this cover element or sheet in the operative position upon the associated stack. In order to ensure that the ram including the cover element or sheet comes to rest upon the stack independent of the height of the stack, when the stack is aligned with the movement axis of the ram, relatively complicated control means including a light barrier are provided. Depending upon the height of the next arriving stack, the light barrier triggers the downward movement of the ram either at an earlier or later moment of time.

By means of a further control arrangement which also possesses a light barrier, the arrival of the ram at the operative position is detected and the return movement into the standby or preparatory position is initiated.

This known apparatus does have the advantage that the movement of the stack does not have to be interrupted for placing the cover elements or sheets, that is the stack does not have to be briefly stopped and thereafter accelerated again. For this purpose, however, a relatively large expense in terms of apparatus and control techniques is necessary.

SUMMARY OF THE INVENTION

Therefore, with the foregoing in mind it is a primary object of the present invention to provide a new and improved construction of an apparatus for placing flat cover elements, preferably cover sheets, onto stacks of flat articles, preferably printed products, and which apparatus is not afflicted with the drawbacks and limitations of the prior art constructions heretofore discussed.

A further important object of the present invention aims at providing a new and improved construction of an apparatus for placing flat cover elements, preferably cover sheets onto flat articles, preferably printed products, and which apparatus allows a reliable placement of flat cover elements or sheets onto stacks of various heights, and wherein such apparatus is constructed in the simplest possible manner and practically not subject to breakdown or malfunction.

Now in order to implement these and still further objects of the invention, which will become more readily apparent as the description proceeds, the apparatus of the present development is manifested by the features that, the placing or placement element, in its operative position, can be temporarily deflected from a rest position by means of the moving stack. The control arrangement or means possesses detecting means which, during such deflection of the placing element, respond and thereby cause a return movement of the placing element into the standby or preparatory position.

As soon as the placing element has reached its operative position which depends upon the height of the stack and in which the cover element or sheet is placed onto a stack, the placing element is entrained by the moving stack and is thereby deflected from its rest position. When such a deflection is detected, the return movement of the placing element into the standby or preparatory position is initiated. For this purpose no particularly complicated means are necessary.

In a particularly preferred embodiment of the inventive apparatus and in the rest position of the placing element, a predetermined displacement direction of the placing element forms an acute angle with the predetermined movement or conveying direction of the stack, i.e. the movement path or track of the placing element is inclined relative to the predetermined conveying path of the stack. This now has the advantage that, with proper coordination of the movement or advance speeds of the placing element and of the stacks as well as the magnitude of the angle formed between the displacement direction of the placing element and the movement or conveying direction of the stack, it can be ensured that the placing element correctly impinges upon the stack independent of the height of the stack. The cover element or sheet therefore is placed in the proper position without there being required any especially complicated control means or arrangements.

It is frequently desired that, apart from the cover element or sheet, still further flat articles are placed onto the stack, for example, additional or supplementary sheets which, however, must lie underneath the cover element or sheet. Such positionally correct collating or assembling of the cover element or sheet and further flat articles is rendered possible in a simple manner by means of an apparatus which contains feed means with at least one endless conveyor belt. This endless conveyor belt possesses a first run facing the further flat articles to be fed or conveyed. The endless conveyor belt is displacable by drive means in a predetermined travel direction and possesses a second run which engages a preselected, preferably stationary structural member. During its movement in the predetermined travel direction, the endless conveyor belt can be driven due to the rolling or generating movement of its second run in engagement with the preselected structural member.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
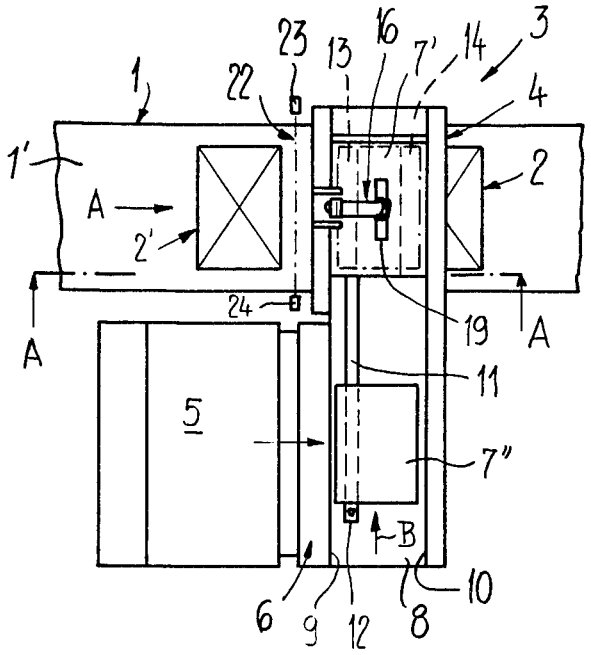
FIG. 1 is a top plan view of an exemplary embodiment of the inventive apparatus for placing cover elements or sheets onto stacks of flat articles, namely printed products.

Describing now the drawings, it is to be understood that only enough of the structure of the apparatus has been illustrated as needed for those skilled in the art to readily understand the underlying principles and concepts of the present development while simplifying the showing of the drawings. Turning attention now specifically to FIGS. 1 to 6, the construction merely schematically depicted therein by way of example and not limitation, will be seen to contain an apparatus for placing at least cover elements or sheets, especially flat cover elements or sheets, onto stacks of flat articles, especially printed products. Only the most important components of such apparatus have been illustrated.

In these FIGS. 1 to 6 a conveyor belt is generally designated by reference numeral 1 and its predetermined conveying direction is indicated by the arrow A. The conveyor belt 1 serves to move the stacks 2 of printed products past a cover element or sheet emplacement station 3 along a predetermined conveying path 1'. Instead of a conveyor belt there can also be used any other conveying means or installations suitable for this purpose.

The cover element or sheet emplacement station 3 possesses a frame 4 which extends over the conveyor belt 1. A printer or printing installation 5 as well as a cutting installation 6, see FIG. 1, are arranged laterally of the conveyor belt 1 and are mounted at the frame 4, see FIG. 1. The printer or printing installation 5 is of known construction and serves to print dispatch or shipping data on the cover elements or sheets 7. The printed cover elements or sheets 7 are cut to size in the cutting installation 6 which is series-arranged to the printer or printing installation 5. The cover elements or sheets 7 leaving the cutting installation 6, arrive on a support or support table 8 which extends in a direction at right angles to the predetermined conveying direction A of the conveyor belt 1. This support or support table 8 is provided with two lateral guides 9 and 10 for the cover elements or sheets 7. The support or support table 8 constitutes a preselected stationary structural member for a purpose to be described hereinafter.

Furthermore, the support or support table 8 possesses an opening or slot 11 which extends at right angles to the predetermined conveying direction A of the conveyor belt 1 and through which extends a thrust element 12 of drive means 12, 25, 30. This thrust element 12 is reciprocated along the opening or slot 11 by not particularly illustrated drive means 25, 30 and in a predetermined travel direction indicated by the arrow B, see FIG. 1. The support or support table 8 is followed by two in cross-section substantially L-shaped support rails 13 and 14 which are arranged above the conveying or movement path 1' of the stack 2 of flat articles, preferably printed products. A gap or clearance 15, see FIGS. 2 to 6, is present between the support rails 13 and 14.

Above these support rails 13 and 14 there are arranged displacing or displacement means 16, 17, 18 containing a piston-cylinder unit 16 having a cylinder 17 which is pivotably mounted at the frame 4 about an axis 17*a* which extends approximately at right angles to the predetermined conveying or movement direction A of the printed product stack 2. The piston rod 18 of this piston-cylinder unit 16 carries at its end a bar or rod-shaped placing or placement element 19 which, for instance, constitutes a metal rod and is provided with a pad or cushion.

In its rest position the piston-cylinder unit 16 is supported at a buffer 20 mounted at the frame 4. This buffer 20 is arranged and constructed such that the piston-cylinder unit 16, in its aforementioned rest position, is inclined relative to the conveyor belt 1, see FIGS. 2, 3, 4 and 6. In this rest position the predetermined displacement direction C of the piston rod 18 and the placing element 19 form an acute angle $\alpha$ with the predetermined conveying or movement direction A of the printed product stacks 2, see FIG. 4. As shown in FIGS. 1 to 6, the inclination of the piston-cylinder unit 16 is such that when the piston rod 18 is extended, the placing element 19 is displaced downwardly as well as forwardly in the predetermined conveying direction A of the conveyor belt 1.

As further evident from FIGS. 2 to 6, a stationary detecting means or detector 21 cooperates with the piston-cylinder unit 16 and responds, in a manner still to be described, to a deflection of the piston-cylinder unit 16 from its rest position. This detecting means or detector 21, for example, may constitute a proximity switch or a microswitch of known construction. The detecting means or detector 21 is a member of a control arrangement or means 21, 22, 23, 24 which further contains a light barrier 22 of known construction, see FIG. 1. This light barrier 22 contains a light transmitter 23 and a light receiver 24. This light barrier 22 is arranged forwardly of the cover sheet emplacement station 3, as seen in the predetermined conveying or movement direction A of the printed product stack 2, and generates, when interrupted by a passing printed product stack 2, a control signal which triggers the extension of the piston rod 18.

In the following there will now be described in greater detail the placement of a cover element or sheet 7 onto the passing printed product stack 2.

Figure 2:
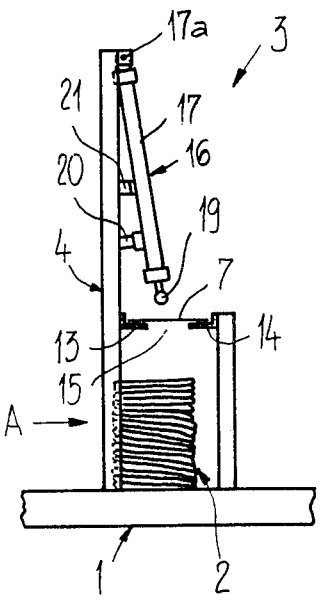
FIGS. 2 to 6 each are sectional views approximately along the line A—A in FIG. 1 and illustrate consecutive operational phases of the apparatus shown in FIG. 1.

The cover elements or sheets 7 which have been cut to size at the cutting installation 6 and which have been imprinted at the printer or printing installation 5, arrive at the support or support table 8. By means of the thrust element 12 the cover elements or sheets 7 are pushed in the predetermined travel direction indicated by the arrow B to a waiting position in which they bear upon the support rails 13 and 14. FIG. 2 shows a cover element or sheet 7 in this waiting position. During the working or operational phase illustrated in FIG. 2, the piston-cylinder unit 16 is located in its rest position and rests against the buffer 20. The piston rod 18 is retracted and the placing element 19 assumes the standby or preparatory position.

Figure 3:
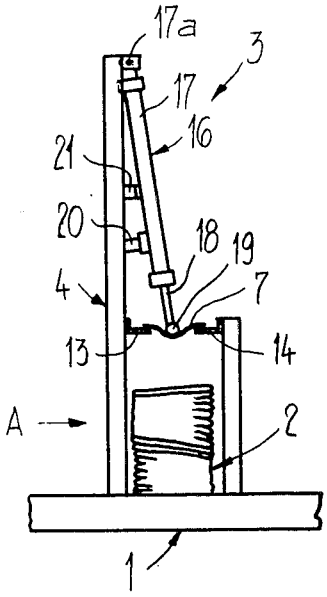

When now a printed product stack 2 passes through the light barrier 22, then, possibly after a certain time delay, the piston rod 18 is extended with the result that the placing element 19 operates upon the cover element or sheet 7 which is located in the waiting position on the support rails 13 and 14, see FIG. 3. During further movement or extension of the piston rod 18 in the predetermined displacement direction indicated by the arrow C, the cover element or sheet 7 is moved away from the support rails 13 and 14, pushed through the gap or clearance 15 downwardly toward the printed product stack 2 and placed upon this printed product stack 2, see FIG. 4. The conveying speed of the conveyor belt 1, the moment of time at which the extending movement of the piston rod 18 is triggered, as well as its movement or extending speed are interrelated such that the placing element 19 arrives at the correct moment of time at the printed product stack 2. The cover element or sheet 7 is displaced from its waiting position and placed onto the printed product stack 2 without any assistance by grippers or suction heads or other elements of such type.

Figure 4:
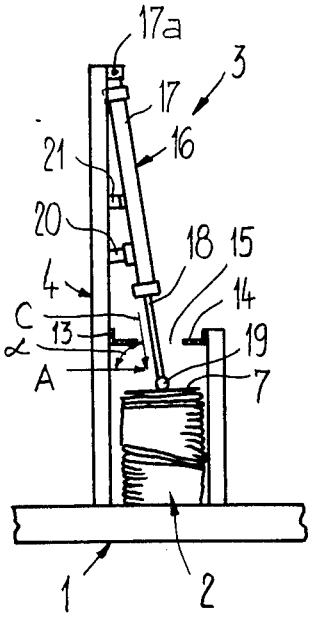
Figure 5:
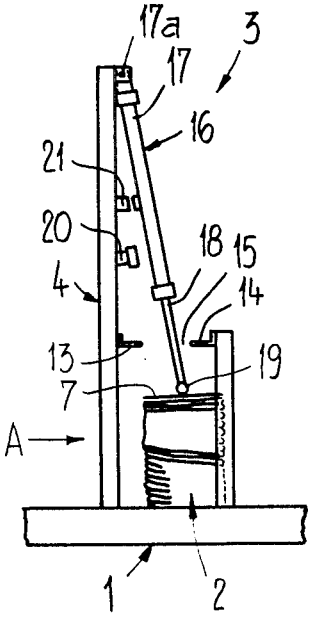
Figure 6:
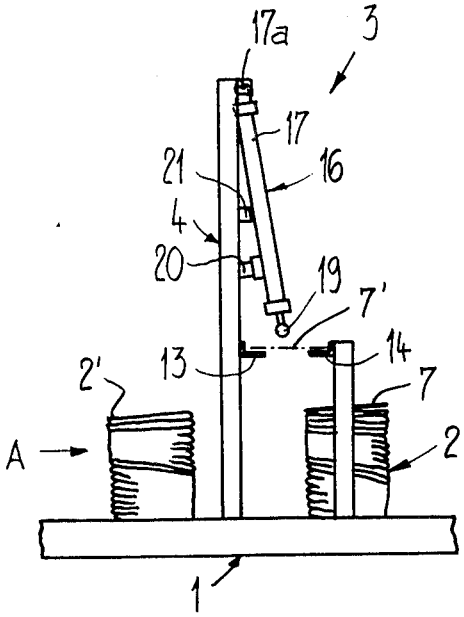

When now the placing element 19 arrives at the operative position depicted in FIG. 4 and presses the cover element or sheet 7 against the printed product stack 2, then this placing element 19 is entrained by the stack 2 which continues to be moved at constant speed. In this respect it should be noted that the piston rod 18 still continues its extending movement since until this time no reversing command has been generated. The entrainment of the placing element 19 has the result that the piston-cylinder unit 16 is lifted-off from the buffer 20, i.e. it is deflected from its rest position as illustrated in FIG. 5. As soon as the piston-cylinder unit 16 moves away from its rest position, the detecting means or detector 21 responds and generates a control signal which effects the retraction of the piston rod 18. As soon as the placing element 19 is located again above the support rails 13 and 14, a further cover element or sheet 7' is displaced into the waiting position in the heretofore described manner and as shown in FIG. 6. On arrival of the next-following printed product stack 2', this further cover element or sheet 7' is placed onto such next-following printed product stack 2' in the manner described hereinbefore.

The inclination of the piston-cylinder unit 16 not only has the advantage that there is rendered possible thereby the deflection of the piston-cylinder unit 16 from its rest position by means of the printed product stack 2 without the printed products within the stack 2 being displaced relative to each other or without the printed product stack 2 falling apart. This inclination also permits placing the cover elements or sheets 7 to be placed onto the printed product stacks 2 of varying height without requiring an additional control arrangement for this purpose.

The start of the extending movement of the piston rod 18 which, as already mentioned, is determined by the passage of the printed product stack 2 through the light barrier 22, always remains the same independent of the height of the printed product stack 2. With printed product stacks 2 of a lower height, however, the travel distance of the placing element 19 between its standby or preparatory position and its operative position is longer than in the presence of higher printed product stacks 2. Due to the inclination of the piston-cylinder unit 16, however, the travel distance of the printed product stack 2 until such stack is impinged by the placing element 19, is also correspondingly greater because the conveying speed of the conveyor belt 1 as well as the extending speed of the piston rod 18 remain the same. Therefore, it is not necessary to adapt the triggering moment of time for the extension of the piston rod 18, its extension speed, or the conveying speed of the conveyor belt 1 to the stack height. It is only necessary to match the last-mentioned magnitudes as well as the angle $\alpha$ of inclination of the piston-cylinder unit 16.

It is frequently desired that apart from the cover element or sheet 7 still further flat articles like, for example, additional or supplementary sheets should be placed onto the printed product stack 2, for example, announcement or advertising sheets for display at a sales location. These additional or supplementary sheets, however, must come to rest below the cover element or sheet 7 which contains the dispatch or shipping data.

Figure 7:
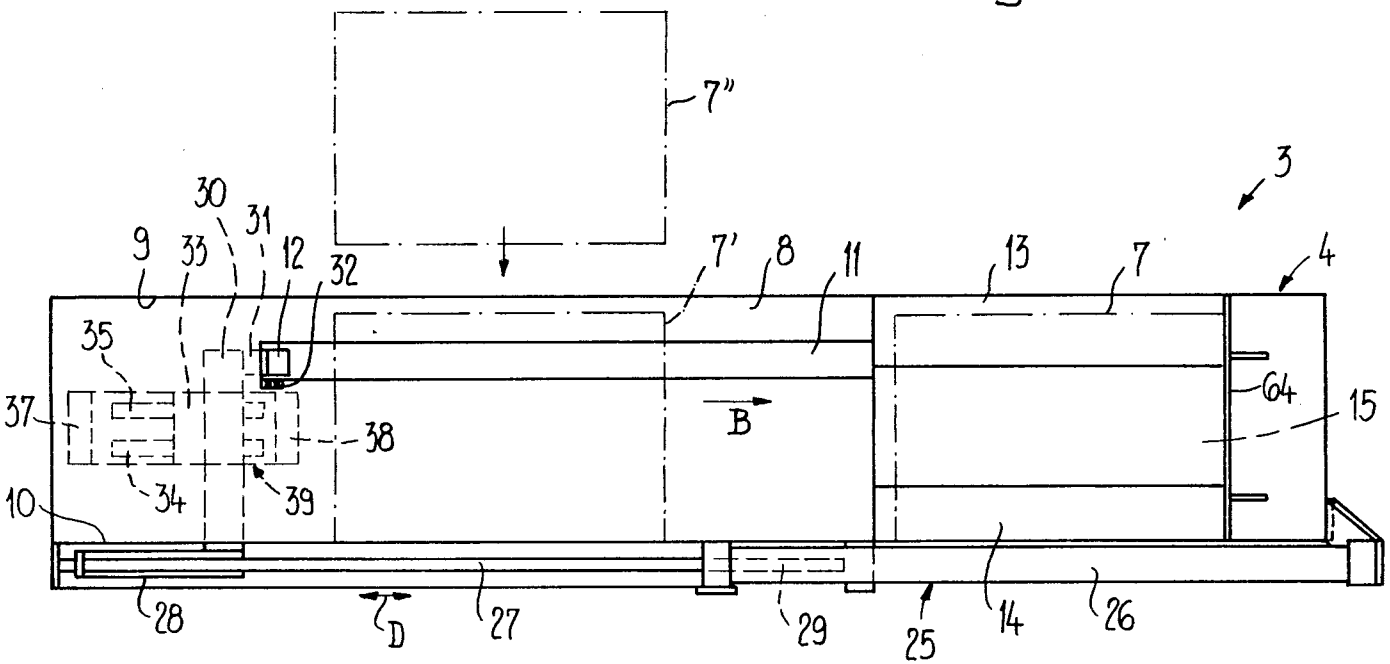
FIG. 7 is a top plan view on an enlarged scale of a part of the apparatus shown in FIG. 1 and illustrates an exemplary embodiment of an apparatus for collating or assembling a cover element or sheet and further flat articles, namely additional or supplementary sheets, arranged below said cover element or sheet.
Figure 8:
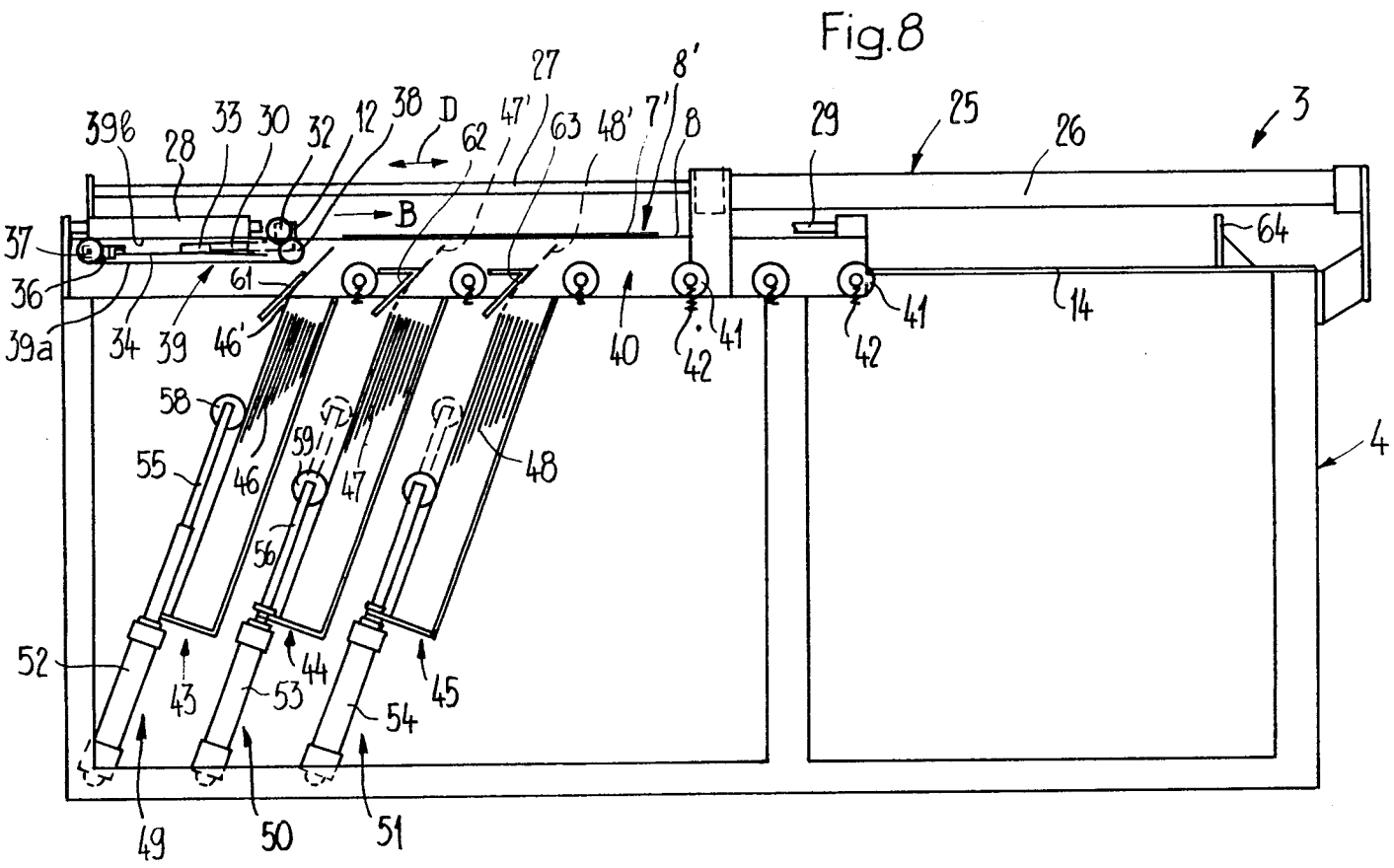
FIG. 8 is a side view of the collating or assembling apparatus shown in FIG. 7 during one phase of its operation.
Figure 9:
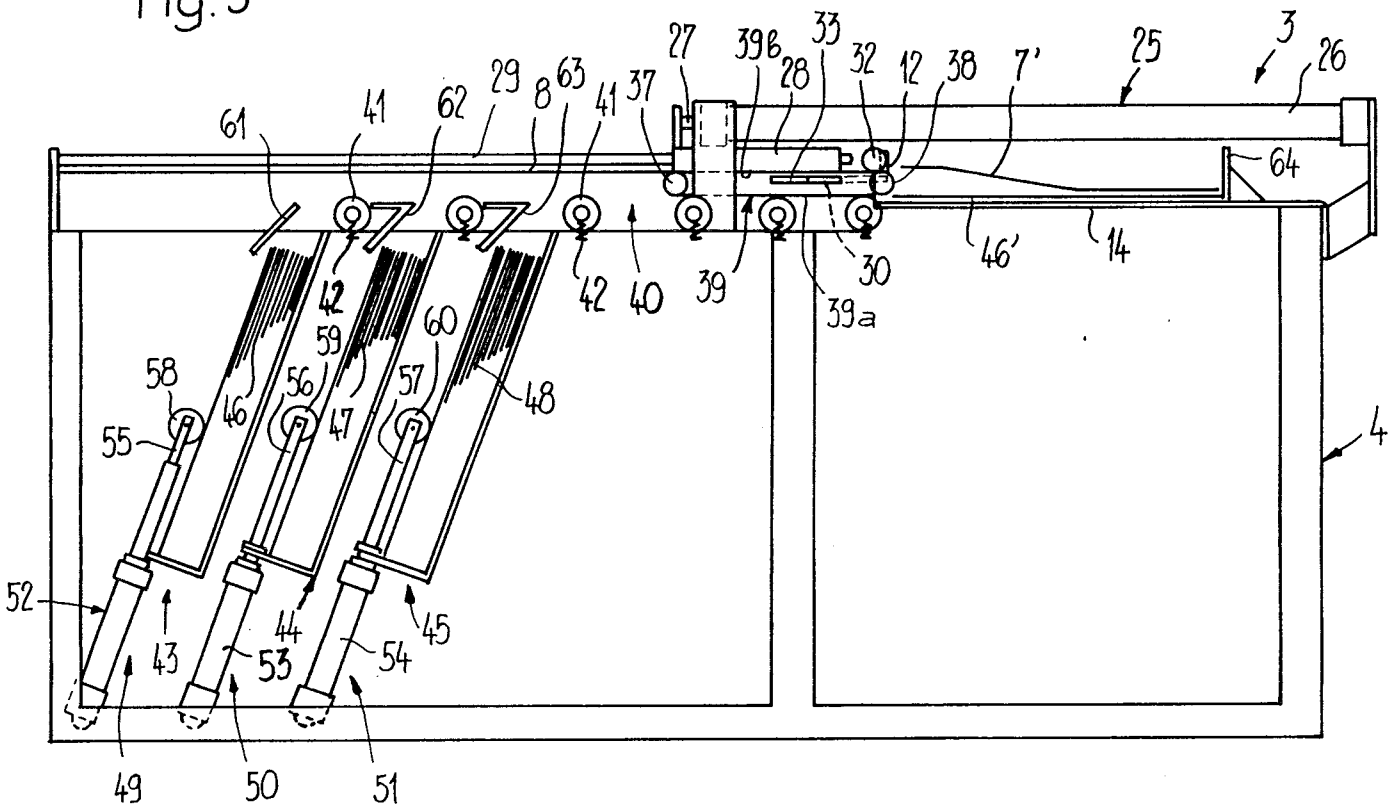
FIG. 9 is a view similar to FIG. 8 and shows the collating or assembling apparatus during a later phase of its operation.

There is now shown in FIGS. 7 to 9 an exemplary embodiment of a collating or assembling apparatus used in combination with the apparatus as described hereinbefore with reference to FIGS. 1 to 6. Such collating or assembling apparatus permits the cover elements or sheets and additional or supplementary sheets to be placed in the desired arrangement into the waiting position. For the sake of clarity, the conveyor belt 1 and the piston-cylinder unit 16 are not depicted in FIGS. 7 to 9.

As shown in FIGS. 6 to 9, there is present a piston-cylinder unit 25 of the drive means 12, 25, 30. This piston-cylinder unit 25 has a cylinder 26 which is secured to the frame 4 in a reposing position.

A connecting member or piece 28 is connected with a piston rod 27 of the aforementioned piston-cylinder unit 25. The connecting member or piece 28 is lengthwise guided by means of a guide rod 29 which extends in the longitudinal direction of the piston-cylinder unit 25. A transverse beam or carrier 30 of the drive means 12, 25, 30 is connected with this connecting member or piece 28 and carries at its free end an extension or bracket 31, see FIG. 7. To this extension or bracket 31, there is secured the thrust element 12 of the drive means 12, 25, 30. Both the transverse carrier or beam 30 as well as the extension or bracket 31 extend underneath the support or support table 8 for the cover elements or sheets 7. Furthermore, there is rotationally mounted at the thrust element 12, a support roll 32 which bears upon the top side of the support or support table 8.

Holding means 33 of feed means 33 to 39 are mounted laterally of the transverse carrier or beam 30 and hold two blade spring elements 34 and 35 which extend parallel to each other, see FIG. 7. These blade spring elements 34 and 35 each carry at one of their ends a support member 36 for a related one of two deflection rolls 37 and 38. Of these two support members 36, only the support member 36 for the deflection roll 37 is illustrated in FIG. 8.

The feed means 33 to 39 further comprise an endless conveyor belt 39 which is guided at the aforementioned deflection rolls 37 and 38. The second or upper run **39*b* of this conveyor belt 39 engages the underside of the support or support table 8 and is pressed against the support or support table 8 by means of the blade spring elements 34 and 35. The opposite first or lower run 39*a* of the conveyor belt 39 forms the effective or active conveying run of the conveyor belt 39**.

Below a first predetermined travel path or track 8' for the cover elements or sheets 7 and also below the conveyor belt 39, there is arranged a second predetermined conveying path or track 40 which extends parallel to the first travel path or track 8'. This second conveying path or track 40 is formed by rollers 41 which are arranged parallel to one another and which are supported at only schematically indicated springs 42. Beneath this second conveying path or track 40 there are arranged receiving or storage bins 43, 44, 45 accommodating respective additional or supplementary sheets 46, 47, 48 which constitute further flat articles. The receiving or storage bins 43, 44, 45 constitute removable inserts and are placed in an upright position, however, are inclined to some extent relative to the vertical.

Each receiving or storage bin 43, 44, 45 is associated with a feed or outfeed mechanism 49, 50, 51 acting upon the related additional or supplementary sheets 46, 47, 48. Each of these feed or outfeed mechanisms 49, 50, 51 possesses a respective piston-cylinder unit 52, 53, 54 with a respective piston rod 55, 56, 57 carrying a respective rubber roller 58, 59, 60. These rubber rollers 58, 59, 60 may contain freewheel mechanisms which are effective when the piston rods 55, 56, 57 are retracted. When the piston rods 55, 56, 57 are extended, each respective topmost additional or supplementary sheet 46', 47', 48' is upwardly pushed or ejected into the working or operating range of the first or lower or active conveying run **39*a* of the conveyor belt 39. By means of guide elements 61, 62, 63 which are arranged above the related receiving or storage bins 43, 44, 45 the upwardly pushed additional or supplementary sheets 46', 47', 48'** are deflected to some degree in the predetermined travel direction indicated by the arrow B.

The piston-cylinder units 52, 53, 54 can be selectively controlled such that during each collating operation the desired number and type of additional or supplementary sheets 46, 47, 48 can be upwardly pushed and entrained.

A stop 64 is provided in order to limit the displacing movement of the cover elements or sheets 7 and the additional or supplementary sheets 46, 47, 48.

The collating and assembling apparatus illustrated in FIGS. 7 to 9 operates as follows:

FIGS. 7 and 8 show both the thrust element 12 as well as the conveyor belt 39 in their rear end position. In this position the piston rod 27 is fully extended. On the support or support table 8 there lies a cover element or sheet 7' which is intended to be placed conjointly with at least one of the additional or supplementary sheets 46, 47, 48 upon the next-following stack 2 of printed products. By controlling the piston-cylinder units 52, 53, 54 the desired additional or supplementary sheets 46, 47, 48 are upwardly pushed. In the case illustrated in FIG. 8, only one additional or supplementary sheet, namely the topmost additional or supplementary sheet 46', is required and its front end protrudes into the predetermined travel direction of the conveyor belt 39.

By retracting the piston rod 27 in the direction of the arrow D, both the thrust element 12 and the conveyor belt 39 are displaced in the travel direction indicated by the arrow B. During such movement, the thrust element 12 pushes the cover element or sheet 7' into its waiting position as already described with reference to FIGS. 1 to 6. As already mentioned, the second or upper run **39*b* of the conveyor belt 39 is pressed against the underside of the stationary support or support table 8 and rolls at the support or support table 8, whereby the conveyor belt 39 is driven in a circulating or revolving manner. The first or lower or active conveying run 39*a* of the conveyor belt 39** thus also moves in the predetermined travel direction indicated by the arrow B.

When the conveyor belt 39 moves past the upwardly pushed additional or supplementary sheet 46', the first or lower or active conveying run **39*a* of the conveyor belt 39 withdraws or extracts this additional or supplementary sheet 46' from the stack and entrains the same as well as any other additional or supplementary sheets, like the additional or supplementary sheets 47' and 48'** which may have been upwardly pushed.

Since the conveyor belt 39, on the one hand, is forwardly moved or displaced at the displacement or transport speed and, on the other hand, also circulates at this displacement or transport speed, the additional or supplementary sheet 46', like possibly also the sheets 47' and 48', is displaced at twice the speed of the cover element or sheet 7'. It is thus ensured that the additional or supplementary sheets 46', 47', 48' arrive at the waiting position at least simultaneously with or even prior to the cover element or sheet 7' although all these additional or supplementary sheets 46', 47', 48' must travel through a greater distance than the cover element or sheet 7'.

Consequently, the cover element or sheet 7', as desired, comes to rest on top of the superposed additional or supplementary sheets 46, 47, 48, as evident from FIG. 9. In FIG. 9 the thrust element 12 and the conveyor belt 39 are shown in their forward end position. The stop 64 ensures that the superposed cover element or sheet 7' and the additional or supplementary sheet 46' are aligned with their leading edges to each other.

By extending the piston rod 27, the thrust element 12 and the conveyor belt 39 are returned into their rear end position. Thereafter, a further collating and assembling operation of a cover element or sheet 7 and additional or supplementary sheets 46, 47, 48 can follow.

The herein described apparatus, of course, can be formed or constructed with respect to various parts in a manner different from that illustrated. For example, it is possible to construct the conveyor belt 39 of a multiple of juxtaposed small conveyor belts.

While there are shown and described present preferred embodiments of the invention, it is to be distinctly understood that the invention is not limited thereto, but may be otherwise variously embodied and practiced within the scope of the following claims.

Accordingly, what I claim is:

1. An apparatus for placing at least a flat cover element, preferably a cover sheet, onto a stack of flat articles, preferably printed products, comprising:

a placing element displacable between a standby position and an operative position;

conveying means for conveying the stack of flat articles along a predetermined conveying path past said placing element;

control means for controlling the displacement of said placing element between said standby position and said operative position;

said control means initiating, on arrival of one of said stacks of flat articles, said displacement of said placing element towards said operative position in order to thereby place at least said flat cover element from a predetermined waiting position onto said one stack of flat articles and which one stack is conveyed past said placing element along said predetermined conveying path by said conveying means;

said control means, after placement of at least said cover element onto said one stack, initiating a return movement of said placing element toward said standby position;

said placing element assuming a predetermined rest position;

said placing element, in said operative position, being transiently deflectable from said predetermined rest position by means of said one stack of flat articles;

said control means containing detecting means responsive to said deflection of said placing element from its rest position; and said detecting means of said control means, on response to said deflection of said placing element from its rest position, initiating said return movement of said placing element toward said standby position.

2. The apparatus as defined in claim 1, wherein:

said standby position of said placing element constitutes a top position; and said operative position of said placing element constitutes a bottom position of said placing element.

3. The apparatus as defined in claim 1, wherein:

said conveying means conveying said one stack of flat articles along said predetermined conveying path, defines a predetermined conveying direction;

said placing element being mounted for pivoting about a predetermined pivot axis; and said pivot axis extending transversely relative to said predetermined conveying direction defined by said conveying means.

4. The apparatus as defined in claim 3, wherein:

said predetermined pivot axis about which said placing element is pivotable, extends substantially at right angles relative to said predetermined conveying direction.

5. The apparatus as defined in claim 3, wherein:

said placing element, in its rest position, defining a predetermined displacement direction in which said placing element is displaced from said standby position to said operative position of said placing element; and said predetermined displacement direction forming an acute angle with said predetermined conveying direction defined by said conveying means.

6. The apparatus as defined in claim 1, further including:

displacing means for displacing said placing element between its standby position and its operative position;

said displacing means containing a pivotably mounted piston-cylinder unit containing a piston rod; and said placing element being mounted at said piston rod.

7. The apparatus as defined in claim 6, wherein:

said conveying means which convey said one stack of flat articles along said predetermined conveying path, define a predetermined conveying direction;

said pivotably mounted piston-cylinder unit being held at an inclined position relative to said predetermined conveying direction defined by said conveying means; and said pivotably mounted piston-cylinder unit being deflectable from said inclined position, in said operative position of said placing element, by means of said passing one stack of flat articles which is conveyed by said conveying means.

8. The apparatus as defined in claim 1, wherein:

said detecting means of said control means and responsive to said deflection of said placing element from its rest position, constitutes a switching element.

9. The apparatus as defined in claim 8, wherein:

said switching element constitutes_a proximity switch.

10. The apparatus as defined in claim 8, wherein:

said switching element constitutes a microswitch.

11. The apparatus as defined in claim 1, further including:

drive means for moving one of said flat cover elements along a first travel path into said waiting position of said flat cover element.

12. The apparatus as defined in claim 11, wherein:

said drive means contain a thrust element.

13. The apparatus as defined in claim 11, further including:

feed means for feeding at least one further flat article into said waiting position; and said feed means being operable such that said at least one further flat article is located below said flat cover element in said waiting position thereof.

14. The apparatus as defined in claim 13, wherein:

said at least one further flat article constitutes at least one supplementary sheet.

15. The apparatus as defined in claim 13, wherein:

said feed means define a second travel path; and said second travel path extending below and substantially parallel to said first travel path defined by said drive means.

16. The apparatus as defined in claim 13, further including:

a preselected structural member;

said feed means containing at least one endless conveyor belt;

said at least one endless conveyor belt containing a first run facing said further flat articles to be fed;

drive means for displacing said at least one endless conveyor belt in a predetermined travel direction;

said at least one endless conveyor belt containing a second run;

said second run of said at least one endless conveyor belt engaging said preselected structural member; and said first run of said at least one endless conveyor belt being drivable by means of a rolling movement of said second run of said at least one endless conveyor belt at said preselected structural member during said displacement of said at least one endless conveyor belt in said predetermined travel direction by said drive means.

17. The apparatus as defined in claim 16, wherein:

said preselected structural member constitutes a stationary structural member.

18. The apparatus as defined in claim 16, further including:

a support for supporting said flat cover element;

said support defining an underside; and said second run of said at least one endless conveyor belt engaging said underside of said support.

19. The apparatus as defined in claim 15, further including:

at least one receiving bin accommodating said further flat articles;

said at least one receiving bin being arranged below said second travel path defined by said feed means;

outfeed means for outfeeding said further flat articles from said at least one receiving bin;

said feed means defining an operating range; and said outfeed means outfeeding said further flat articles from said at least one receiving bin into said operating range of said feed means.

20. The apparatus as defined in claim 19, wherein:

said at least one receiving bin is inclined relative to said second travel path defined by said feed means.

21. The apparatus as defined in claim 16, wherein:

said drive means for displacing said at least one endless conveyor belt in said predetermined travel direction and said drive means for moving said flat cover element along said first travel path, constitute common drive means for displacing said at least one endless conveyor belt and moving said flat cover element.

* * * * *